United States Patent [19]

Archer

[11] 4,162,095

[45] Jul. 24, 1979

[54] CABLE SLINGS

[75] Inventor: Jean-Francois Archer, Villennes, France

[73] Assignee: Stas - Societe Technique d'Accessoire Specialises, Sartrouville, France

[21] Appl. No.: 792,229

[22] Filed: Apr. 29, 1977

[30] Foreign Application Priority Data

May 13, 1976 [FR] France ..... 76 15160

[51] Int. Cl.[2] ..... B66C 1/18

[52] U.S. Cl. ..... 294/74

[58] Field of Search ..... 294/74, 75, 76, 77, 294/78; 24/122.3, 122.6; 87/8

[56] References Cited

U.S. PATENT DOCUMENTS

| | | | |
|---|---|---|---|
| 3,307,870 | 3/1967 | Archer | 294/74 |
| 3,672,006 | 6/1972 | Fidrych | 294/74 |
| 3,722,942 | 3/1973 | Baur | 294/74 |

*Primary Examiner*—James B. Marbert

*Attorney, Agent, or Firm*—Karl F. Ross

[57] ABSTRACT

A cable sling comprises a loop formed by folding back one end of the cable and retaining this end adjacent another part of the cable by means of a sleeve. A marking plate carrying indicia, such as the load-bearing capacity of the sling, is held within the loop adjacent the sleeve. The marking plate is of U-shaped form and is retained within the loop by a U-shaped retaining cable which is threaded through the plate, with the free ends of the retaining cable being anchored within the sleeve.

7 Claims, 5 Drawing Figures

CABLE SLINGS

BACKGROUND OF THE INVENTION (1) Field of the Invention

The present invention relates to a cable sling, and more particularly to a cable sling marking plate bearing indicia relating to the sling.

(2) Description of the Prior Art

Cable slings have been proposed in the form of at least one loop obtained by folding back at least one end of the cable, and securing the end to the remainder of the cable by means of a sleeve. As a practical matter, a cable sling should usually bear an indication of the maximum loading it is able to withstand, as well as the manufacturer's name and such indications must remain constantly legible. These indications may be provided by press-forming indicia in the sleeve. However, if the sleeve is made of aluminum, the inidica become rapidly deleted. This drawback does not occur if the sleeve is made of steel, but in this event the indicia then reduce dangerously the strength of the sleeve, as the thickness of a steel sleeve is considerably less than that of an aluminum sleeve.

It has also been proposed to fix inside the sleeve the end of a small cable whose other end is connected to a label bearing the required indicia; but this label can move relative to the sling, through the bending or twisting of the small cable, with the result that the latter ultimately breaks.

SUMMARY OF THE INVENTION

According to the present invention, there is provided a marking plate for a cable sling of the type formed by a cable of which at least one end is folded back in such a manner as to form a loop and a sleeve retaining the the end of the cable, the marking plate comprising a stirrup member which is fitted into the crotch at the end of the loop adjacent to the sleeve, and a retaining cable operative to secure the stirrup member to the sleeve, said retaining cable being folded back to provide two ends, said two ends being imprisoned in the sleeve.

Further according to the present invention, there is provided a cable sling, said sling comprising a cable having an end portion bent back to lie adjacent another part of the cable and to define therewith a cable loop, and a sleeve securing the cable end to the other part of the cable, an indicia-bearing marking plate for the sling, the marking plate being of generally U-shaped form and comprising a base and limbs extending from the base. The plate is located within the loop adjacent the sleeve, with the said end portion and the other part of the cable lying between the limbs of the plate and the base of the plate facing the end of the sleeve, and an elongate flexible retaining member retains the plate within the loop, the retaining member being bent into U-shaped form to provide two limbs, said two limbs of the retaining member extending through the marking plate, and the free end portions of the limbs of the retaining member being anchored within the sleeve.

BRIEF DESCRIPTION OF THE DRAWINGS

An embodiment of the invention will now be described, by way of example, only with reference to the accompanying diagrammatic drawing, in which.

DESCRIPTION OF THE PREFERRED EMBODIMENT

Figure 1:
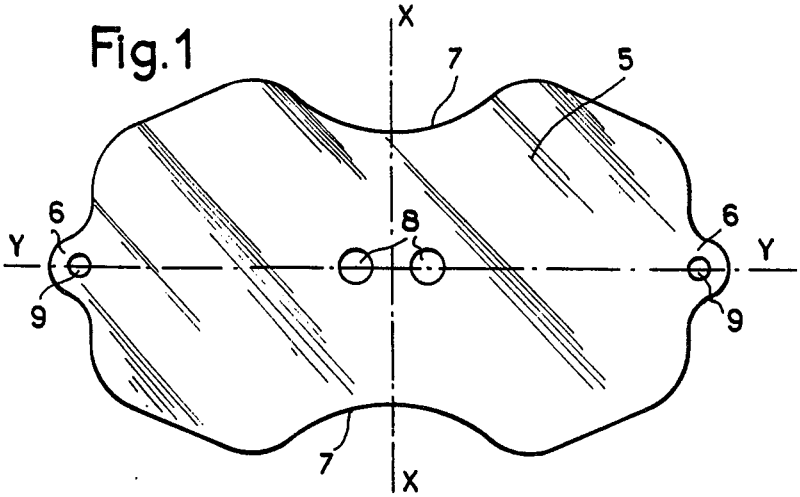
FIG. 1 is a plan view of a blank for forming a marking plate in accordance with the invention.

There is shown in the drawings a marking plate 1 bearing indicia to provide such information as the maximum loading and/or the manufacturers name, and/or any other required information. The marking plate is intended for use with a cable sling constituted by a cable 2, at least one end 2*a* of which is folded back in such a manner as to form at least one loop 3 and is fixed to the cable 2 by means of a crimped sleeve 4. The plate 1 is made from a blank 5 having two axes of symmetry X—X and Y—Y perpendicular to each other (FIG. 1). The two halves of the blank situated on either side of the axis X—X are approximately trapezoidal, their sides being substantially at an angle of 45° one relative to the other; their small base is extended by a lug 6. Two rounded notches 7 are provided on the edges of the blank on either side of the axis X—X. Pairs of holes 8 and 9 are formed in the blank 5 along the axis Y—Y, respectively in the central portion of the blank at a short distance from the axis X—X, and in the lugs 6.

Figure 2:
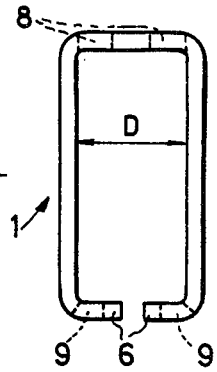
FIG. 2 is a side elevation of a marking plate formed from the blank.
Figure 3:
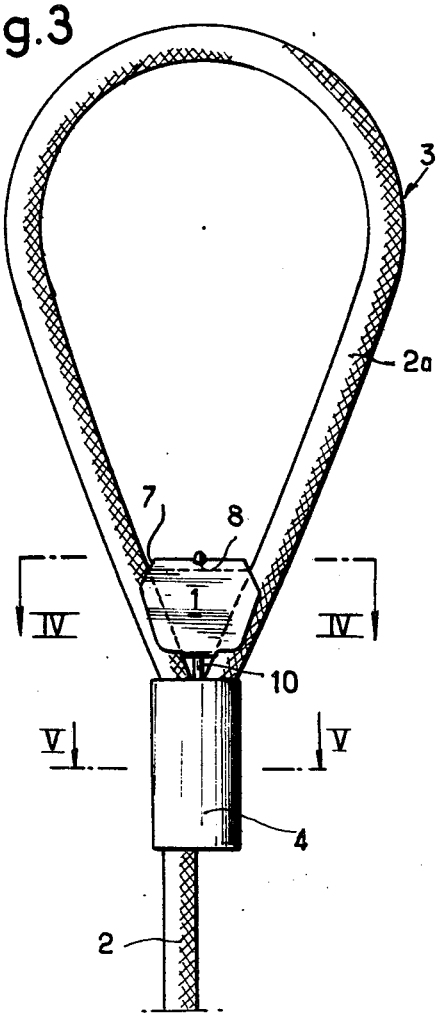
FIG. 3 is an elevation of part of a sling provided with the marking plate.

The blank 5 is folded into the form of a generally U-shaped stirrup (FIG. 2) about two lines parallel with the axis X—X and each lying substantially tangentially to a respective one of the two holes 8, with the two holes 8 lying between the two fold lines. The distance D between the opposite limbs of the stirrup is slightly greater than the diameter of the cable 2. The lugs 6 are folded inwardly at 90 degrees relative to the limbs whereby the lugs 6 are spaced by a short distance from each other. The holes 8 are in the base of the stirrup and notches 7 are located at the opposed side edges of the base; each of the holes 9 faces a respective one of the holes 8 as is clearly shown in FIG. 2.

The marking plate is placed in position when the sling is being made, after the end 2*a* of the cable has been inserted into the sleeve 4, but before the sleeve 4 is crimped. The plate 1 is retained by means of an elongate flexible retaining member formed by a cable 10 folded into U-shaped configuration with each of the limbs of the cable 10 passing through a respective one of the holes 8 and through the hole 9 which faces the hole 8.

Figure 4:
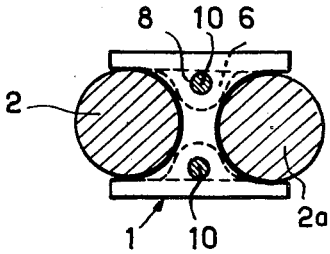
FIG. 4 is a cross-section taken along line IV—IV of FIG. 3.
Figure 5:
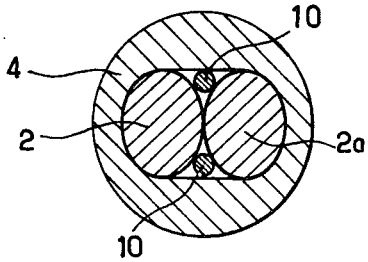
FIG. 5 is a cross-section taken along line V—V of FIG. 3.

After the cable 10 has been threaded through the plate 1, the plate 1 is placed in the end of the loop 3 adjacent to the sleeve 4 in such manner that the cable 2 and its end 2*a* are seated in the respective notches 7 (see FIG. 4) and the ends of the cable 10 pass into the sleeve 4 on either side of the cable 2 and its end 2*a* (see FIG. 5).

Upon crimping of the sleeve 4, the cable 10 is automatically stretched whereby the loop at the upper end portion of the cable 10 pulls the plate 1 downwardly so that the cable 2 and its end 2*a* are firmly engaged in the notches 7.

In the embodiment particularly described the plate 1 is securely, but simply, attached to the sleeve. The plate 1 is protected by the sleeve 4 against damage during use and itself protects the parts of the loop 3 which are adjacent to the sleeve; indeed, these parts are located in the notches 7 and are therefore partly covered by the lateral edges of the plate 1. Moreover, this arrangement prevents the plate 1 from moving transversely relative to the sleeve. There is therefore no deformation of the cable 10 whereby the risk of breaking the cable 10 is avoided. The edges of the notches 7 form abutments for the loop 3 and which prevent the opposite sides of the loop from coming into contact when the loop of the sling is fixed on a mmmber of too small a diameter, for example the shaft of the shackle. Finally, the plate 1 is movable independently of the sleeve in the sense that it does not form with the latter a rigid assembly which could reduce the load-bearing characteristics of the sling when the loop of the sling is fixed on a member of too small a diameter.

what is claimed is:

1. The cable combination which comprises a cable sling formed by a cable of which at least one end is folded back in such a manner as to form a loop and a sleeve retaining the said end of the cable, the loop having a crotch adjacent said sleeve, a marking plate comprising a stirrup member which is threaded onto the end of the loop adjacent to the sleeve, and a retaining cable operative to secure the stirrup member to the sleeve, said retaining cable being folded back to provide two ends, said two ends of the retaining cable being imprisoned in the sleeve.

2. The combination defined in claim 1, wherein said stirrup member has ends extended by folded lugs.

3. The combination defined in claim 2, wherein said lugs have holes for the passage of the retaining cable.

4. The combination defined in claim 1, wherein said stirrup member has a base, said base having holes for the passage of the retaining cable.

5. The combination defined in claim 1, wherein said stirrup member has a base, said base having notches along its opposed sides to seat a respective part of the cable defining the loop.

6. A marking plate for a cable sling of the type formed by a cable of which at least one end is folded back in such a manner as to form a loop and a sleeve retaining the said end of the cable, said marking plate comprising a stirrup member which is threaded onto the end of the loop adjacent to the sleeve, and a retaining cable operative to secure the stirrup member to the sleeve, said retaining cable being folded back to provide two ends, said two ends being imprisoned in the sleeve, the plate being movable relative to the sleeve to prevent the formation of a rigid assembly which could reduce the load-bearing characteristics of the cable when the loop passes around a member of too small a diameter.

7. In combination, a cable sling, said sling comprising a cable having an end portion bent back to lie adjacent another part of the cable and to define therewith a cable loop, and a sleeve securing the cable end to the said other part of the cable, an indicia-bearing marking plate for the sling, said marking plate being of generally U-shaped form and comprising a base and limbs extending from the base, said plate being located within the loop adjacent the sleeve, with the said end portion and said other part of the cable lying between the limbs of the plate and the base of the plate facing the end of the sleeve, and an elongate flexible retaining member for retaining the plate within the loop, said retaining member being bent into U-shaped form to provide two limbs, said two limbs of the retaining member extending through the marking plate, and the free end portions of the limbs of the retaining member being anchored within the sleeve.

* * * * *